US005865333A

United States Patent [19]

Wolfe

[11] Patent Number: 5,865,333

[45] Date of Patent: Feb. 2, 1999

[54] SPORTS CAP DISPLAY

[76] Inventor: Kevin M. Wolfe, 4232 Clough La., Cincinnati, Ohio 45245

[21] Appl. No.: 747,891

[22] Filed: Nov. 13, 1996

Related U.S. Application Data

[63] Continuation of Ser. No. 520,769, Aug. 30, 1995, abandoned.

[51] Int. Cl.[6] ..... A45C 11/02; B65D 6/02

[52] U.S. Cl. ..... 220/4.21; 206/8; 220/4.26; 220/784

[58] Field of Search ..... 220/4.21, 4.24, 220/4.26, 784; 206/8; 223/24; 2/209.12, 195.1

[56] References Cited

U.S. PATENT DOCUMENTS

| | | | |
|---|---|---|---|
| 209,691 | 11/1878 | Jinkins | 206/8 |
| D. 344,233 | 2/1994 | Peters . | |
| 870,550 | 11/1907 | Dod | 206/8 |
| 1,138,414 | 5/1915 | Randolph . | |
| 1,582,102 | 4/1926 | Tuten . | |
| 1,606,811 | 11/1926 | Schilke | 206/8 |
| 2,259,930 | 10/1941 | Gawelek . | |
| 2,586,700 | 2/1952 | Noble . | |
| 2,655,256 | 10/1953 | Guest . | |
| 2,659,481 | 11/1953 | Jones . | |
| 2,677,457 | 5/1954 | Guest . | |
| 2,693,275 | 11/1954 | Smith . | |
| 2,740,567 | 4/1956 | Kaufman . | |
| 4,637,077 | 1/1987 | Henschel . | |
| 4,776,043 | 10/1988 | Coleman | 2/209.12 |
| 4,858,247 | 8/1989 | Hooser . | |
| 4,881,637 | 11/1989 | Peters et al. . | |
| 5,012,531 | 5/1991 | Schoonover . | |
| 5,022,515 | 6/1991 | Agostine . | |
| 5,074,410 | 12/1991 | Fries et al. . | |
| 5,161,719 | 11/1992 | Otteson et al. . | |
| 5,172,837 | 12/1992 | Finney, Jr. et al. | 223/24 X |

FOREIGN PATENT DOCUMENTS

| | | | |
|---|---|---|---|
| 0807026 | 10/1936 | France | 206/8 |

OTHER PUBLICATIONS

"Announcing Cap'it", Announcement from Kinart Enterprises, Oct. 13, 1995.

"Design Patent No. D363,620", Enclosure from Foley & Lardner, Oct. 11, 1995.

*Primary Examiner*—Jes F. Pascua
*Assistant Examiner*—Niki M. Kopsidas
*Attorney, Agent, or Firm*—Steven J. Rosen

[57] ABSTRACT

A cap display for displaying a cap having a bill affixed to a fully opened crown. The cap display having transparent inner and outer shells which are shaped and sized such that the inner shell is smaller than the outer shell and such that the cap can be interposed between them with the cap's crown fully opened. Inner and outer crown portions of the shells generally conform to corresponding inner and outer crown surfaces of the crown of the cap. A shell securing mechanism for releasably securing together the inner and outer shells may be in the form of latching mechanisms disposed on an inner base on the inner shell and an outer base on the outer shell. The shells may include inner and outer risers between the inner and outer bases and the inner and outer bill portions so that a sign may be placed between the risers at front ends of the bill portions. The bases may further include corresponding base rims extending downward from peripheries of the bill and crown portions of the shells and a hook for hooking the cap display may also be incorporated, such as in the form of a tab attached to the outer shell and an aperture in the tab.

16 Claims, 2 Drawing Sheets

SPORTS CAP DISPLAY

This application is a continuation, of application Ser. No. 08/520,769, filed Aug. 30, 1995, now abandoned.

BACKGROUND OF THE INVENTION

1. Field of the Invention

This invention relates to an apparatus for protectively storing and displaying sports and other types of caps such as baseball caps characterized by a crown and a bill. More particularly, the present invention is directed to an apparatus for holding these caps open and in a clear transparent display to protect and preserve the caps.

2. Description of Related Art

Sports caps such as baseball, golf, and racing caps and the like are collected by many people who wish to safekeep and display the caps in a manner that fully displays and protects the caps. Many companies give similar caps to customers to advertise and promote their products and people may also wish to display these caps. Such caps, hereinafter referred to as caps, are characterized by a front bill attached to a crown, wherein the crown is often, but not always, creased so as to allow a back half of the crown to be folded into itself. Protective holders have been developed to house a cap so that the form of the cap is retained during carriage and storage and some modicum of protection for the cap is provided. A form retaining holder or case for storing a visored cap is disclosed in U.S. Pat. No. 5,012,531 provides an upper shell and a lower shell, both shell portions sized and adapted to accommodate a visored type cap, such as used in the game of baseball, when the back portion of the cap is folded forwardly into the interior of the front portion of the cap. This holder interposes a cap having its crown half folded in on itself between upper and lower shells. The upper and lower shells are connected by a fastener and by a lip on the lower surface of the visor portion of the upper shell wherein the lip is adapted to engage the visor of lower shell therein. Though protection is afforded the cap, it is not displayed to its fullest extent, so that the outside and the inside of the crown is fully viewable. Since the crown of the cap is folded undesirable fold lines may develop which may decrease the monetary as well as the aesthetic value of the cap. Furthermore, there is no way to place this holder flat with respect to the bottom rim of the crown for the purpose of displaying the cap. Therefore, it is highly desirable to have a clear protective cap holder that fully displays and holds the form of the crown. Towards this end, the present invention was developed.

SUMMARY OF THE INVENTION

A cap display for displaying a cap having a bill affixed to a fully opened crown, the cap display having transparent inner and outer shells which are shaped and sized such that the inner shell is smaller than the outer shell and such that the cap can be interposed between them with the cap's crown fully opened. Inner and outer crown portions of the shells generally conform to corresponding inner and outer crown surfaces of the crown of the cap.

The outer and inner shells have outer and inner bill portions affixed at their back ends to front ends of outer and inner crown portions, respectively. The crown portions are generally dome shaped. The outer shell is sized and adapted to be slightly larger than and to closely accommodate the inner shell with the cap disposed between the outer and inner shells when the crown of the cap is in a fully opened position. The cap display outer and inner shells are preferably made of a transparent material such as a clear or tinted plastic.

A shell securing means for releasably securing together the inner and outer shells is also provided and may be in the form of latching mechanisms disposed on an inner base on the inner shell and an outer base on the outer shell. The latching mechanisms may include a detente on one of the bases and a corresponding catch in the other of the bases. The catch can be in the form of one of the bases being lower than the other base or a notch in one base. The shells may include inner and outer risers between the inner and outer bases and the inner and outer bill portions which provides a means for placing a sign between the risers at the front ends of the bill portions. The bases may further include corresponding base rims extending downward from peripheries of the bill and crown portions of the shells. A hook fastening means for hooking the cap display to a wall may also be incorporated such as in the form of a tab attached to the outer shell and an aperture in the tab.

ADVANTAGES

Among the advantages provided by the present invention is an inexpensive highly attractive cap display that fully displays all of the cap and helps preserve it and maintain its shape and form and prevent damaging or creasing the cap's material, particularly, in the crown of the cap. The present invention may be used to display or transport caps both at home and in commercial settings. The present invention has the advantage of displaying the entire crown and avoiding undesirable fold lines which may decrease the monetary as well as the aesthetic value of the cap. Another advantage is that the present display cap may be placed flat with respect to the bottom rim of the crown or hung on a hook for the purpose of displaying the cap. Yet another advantage is that the present display cap has an inner crown that fully supports the crown of the cap. This is particularly useful for supporting and preserving older softer cap crowns and displaying such caps.

BRIEF DESCRIPTION OF THE DRAWINGS

The foregoing aspects and other features of the invention are explained in the following description, taken in connection with the accompanying drawings where.

DETAILED DESCRIPTION OF THE INVENTION

Figure 1:
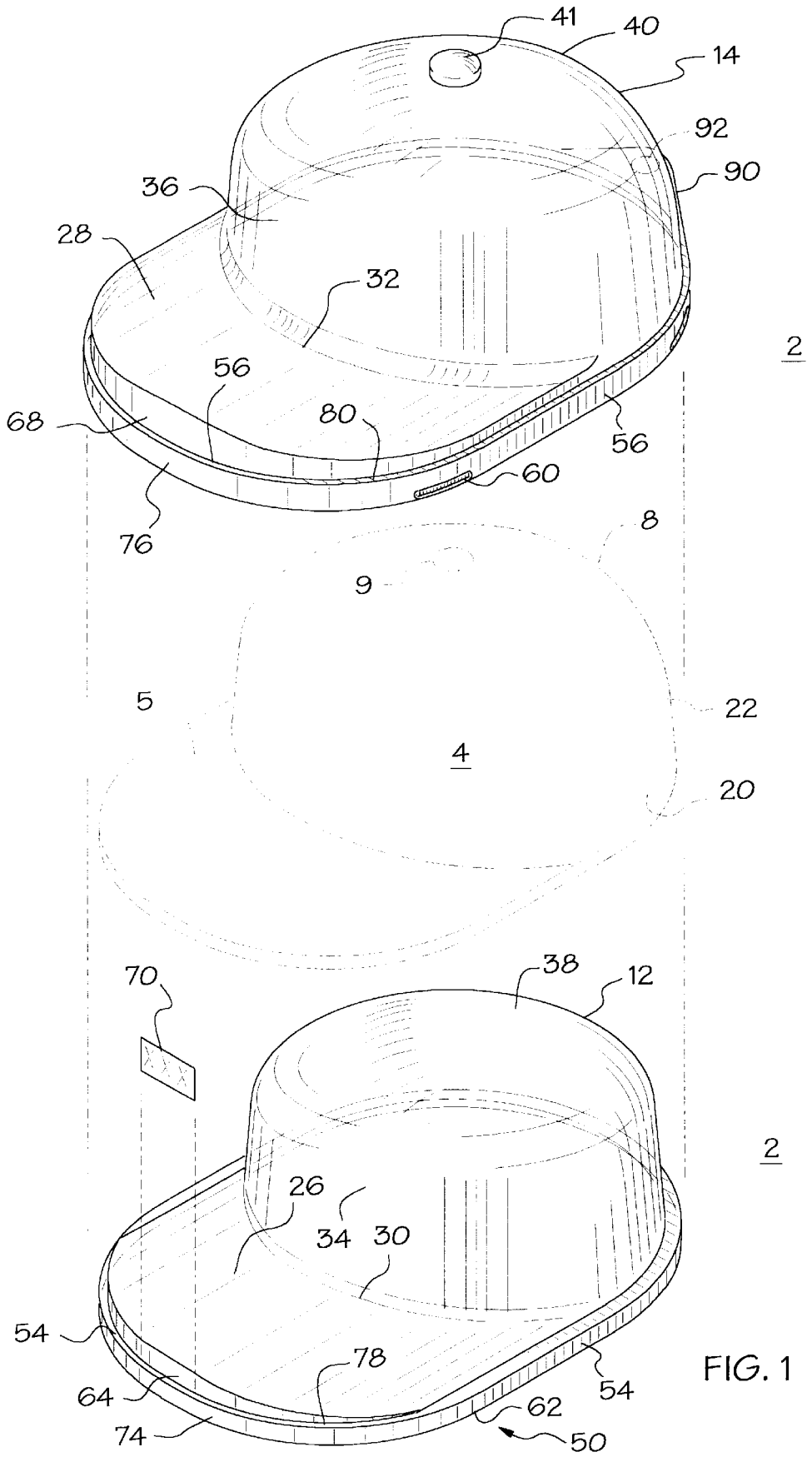
FIG. 1 is an exploded perspective view illustrating a cap display in accordance with an exemplary embodiment of the present invention.
Figure 2:
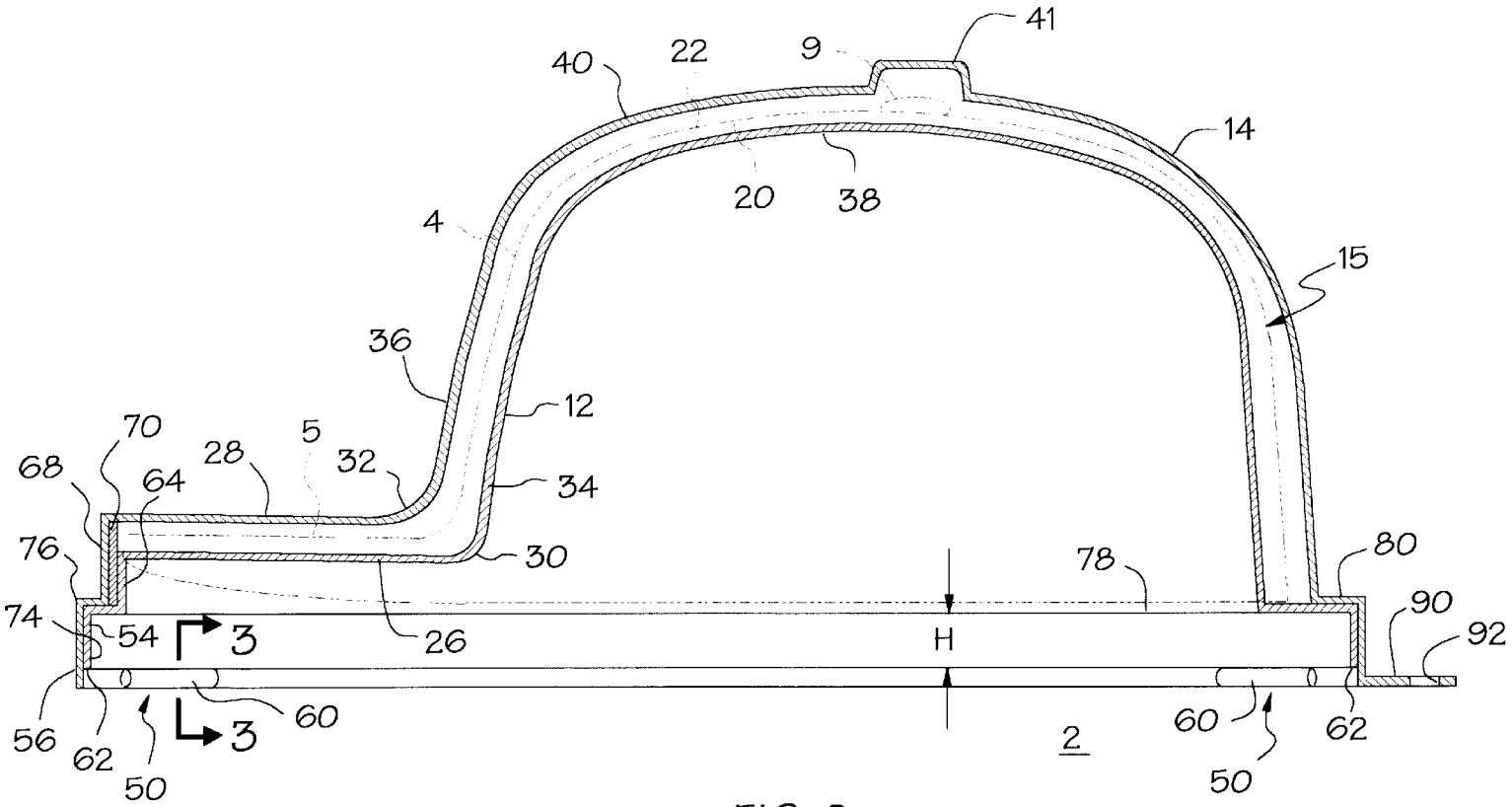
FIG. 2 is a cross sectional view of the cap display illustrated in FIG. 1.

Illustrated in FIGS. 1 and 2 is an exemplary embodiment of the present invention, a cap display 2 for displaying a cap 4 having a bill 5 affixed to a fully opened crown 8 with a button 9 on top of the crown. The cap display 2 having continuous preferably transparent inner and outer shells 12 and 14, respectively which are shaped and sized such that the inner shell is smaller than the outer shell forming an enclosed cavity 15 between the shells and such that the cap 4 can be interposed between the shells with the cap's crown 8 fully opened. Inner and outer crown portions 38 and 40, respectively of the inner and outer shells 12 and 14, respectively, generally conform to each other and corresponding continuous inner and outer crown surfaces 20 and 22, respectively of the crown 8 of the cap 4. This allows the cap display 2 to fully display all of the cap's crown 8 and helps preserve it and maintain its shape and form and prevent damaging or creasing the cap's crown material. This also fully supports the crown 8 of the cap 4 which is particularly useful for supporting and preserving older softer cap crowns and displaying such caps.

The inner and outer shells 12 and 14, respectively have inner and outer bill portions 26 and 28, respectively affixed at their respective inner and outer back ends 30 and 32 to respective inner and outer front ends 34 and 36 of the inner and outer crown portions 38 and 40, respectively. The inner and outer crown portions 38 and 40, respectively are generally dome shaped, and the outer shell 14 is sized and adapted to be slightly larger than and to closely accommodate the inner shell 12 with the cap 4 disposed between the outer and inner shells when the crown 8 of the cap is in a fully opened position. The outer crown portion 40 may include a bubble 41 to accommodate the button 9 of the cap 4. The cap display 2 and its inner and outer shells 12 and 14, respectively are preferably made of a transparent material such as a clear or tinted plastic. Though the cap display of the present invention could be made of a non-transparent material to provide the advantages of the present with respect to preserving and transporting a cap.

Figure 4:
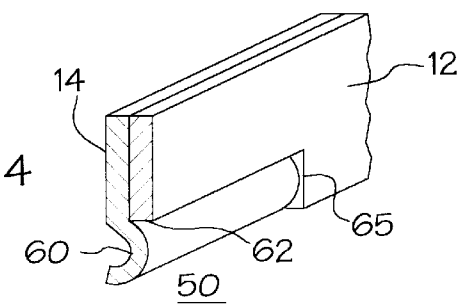
FIG. 4 is a perspective view illustrating an alternative embodiment of the detente latching mechanism of the cap display illustrated in FIG. 2.
Figure 3:
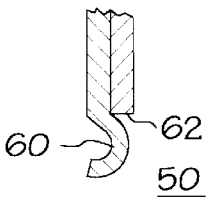
FIG. 3 is a cross sectional view along 3—3 of a detente latching mechanism of the cap display illustrated in FIG. 2.

A shell securing means for releasably securing together the inner and outer shells is provided and illustrated by latching mechanisms 50 disposed on an inner base 54 on the inner shell 12 and an outer base 56 on the outer shell 14. As shown more clearly in FIG. 3, the latching mechanisms may be in the form of, but not limited to, a detente 60 on the inner base 54 and a corresponding catch 62 in the outer base 56. The catch 62 is illustrated in FIGS. 1, 2, and 3 as the inner base 54 being of shorter height H than the outer base 56. FIG. 4 illustrates another embodiment of the catch 62 in which the catch is a notch 65 in the inner base 54. The notches and detentes may be reversed with respect to the bases.

Referring back to FIGS. 1 and 2, the inner and outer bill portions 26 and 28, respectively include inner and outer risers 64 and 68, respectively extending down to the inner and outer bases 54 and 56, respectively to provide a means for placing a sign 70 between the risers at front ends of the bill portions. The sign 70 may be in the form of piece of paper or cardboard, a plastic or metal plaque, or a sticker affixed to one of the risers. The sign 70 may be used to commemorate the cap 4 or contain an informative message.

The inner and outer bases 54 and 56, respectively may further include corresponding inner and outer base rims 74 and 76, respectively which extend downward along inner and outer peripheries 78 and 80, respectively of the corresponding inner and outer bill and inner and outer crown portions 26 and 28, respectively and 38 and 40, respectively of the inner and outer shells 12 and 14, respectively. The inner and outer base rims 74 and 76, respectively form a rim of the cap display 2 which provides an aesthetically pleasing and stable platform for the display as well as adding structural stability to the display which further enhances the protection it affords the cap 4.

A hook fastening means for hooking the cap display 2 such as may be used to place the display on a hook on a wall (not shown) may also be incorporated such as in the form of a tab 90 attached to the outer shell 14 and an aperture 92 in the tab.

While the preferred embodiment of the present invention has been described fully in order to explain its principles, it is understood that various modifications or alterations may be made to the preferred embodiment without departing from the scope of the invention as set forth in the appended claims.

I claim:

1. A cap display for a cap having a bill affixed to a front of a crown, said cap display comprising:

a continuous outer shell having an outer bill portion affixed to an outer crown portion, a continuous inner shell having in inner bill portion affixed to an inner crown portion, said outer and inner crown portions being generally dome shaped, said outer shell sized to be slightly larger than and to closely accommodate said inner shell forming an enclosed cavity within which the cap can be disposed between said outer and said inner shells when the crown of the cap is in a full opened position, an inner riser extending downwardly from the periphery of said inner bill portion, an outer riser extending downwardly from the periphery of said outer bill portion, an inner base extending outwardly from the periphery of said inner riser and said crown portion of said inner shell, an outer base extending outwardly from the periphery of said outer riser and said crown portion of said outer shell, and said bases further comprising corresponding base rims extending downward from peripheries of said bill and crown portions of said shells.

2. A cap display as claimed in claim 1 wherein said outer and inner shells are made of a transparent material.

3. A cap display as claimed in claim 2 further comprising a shell securing means for releasably securing together said inner shell and said outer shell.

4. A cap display as claimed in claim 3 further comprising:

an inner base on said inner shell, an outer base on said outer shell, and wherein said shell securing means comprises at least two latching mechanisms disposed on said bases.

5. A cap display as claimed in claim 4 wherein each of said latching mechanisms comprises a detente on one of said bases and a corresponding catch in other of said bases.

6. A cap display as claimed in claim 5 wherein said catch comprises said other of said bases having a shorter height than said base with said detente.

7. A cap display as claimed in claim 5 wherein said catch comprises a notch in a bottom of said other of said bases.

8. A cap display as claimed in claim 4 wherein:

said crown portions are attached to back ends of said bill portions, said inner bill portion of said inner shell includes an inner riser extending down to said inner base, said outer bill portion of said outer shell includes an outer riser extending down to said outer base, and a sign disposed between said risers at front ends of said bill portions.

9. A cap display as claimed in claim 8 wherein said bases further comprise corresponding base rims extending downward from peripheries of said bill and crown portions of said shells.

10. A cap display as claimed in claim 4 further comprising a hook fastening means for hooking the cap display.

11. A cap display as claimed in claim 10 wherein said hook fastening means comprises a tab attached to said outer shell and an aperture in said tab.

12. A cap display as claimed in claim 2 wherein said crown portions are attached to back ends of said bill portions and said cap display further comprises:

an inner base on said inner shell, an outer base on said outer shell, said inner bill portion of said inner shell includes an inner riser extending down to said inner base, and said outer bill portion of said outer shell includes an outer riser extending down to said outer base.

13. A cap display as claimed in claim 12 wherein said bases further comprise corresponding base rims extending downward from peripheries of said bill and crown portions of said shells.

14. A cap display as claimed in claim 13 further comprising a hook fastening means for hooking the cap display.

15. A cap display as claimed in claim 14 wherein said hook fastening means comprises a tab attached to said outer shell and an aperture in said tab.

16. A cap display as claimed in claim 15 further comprising a sign disposed between said risers at front ends of said bill portions.

* * * * *